US006745507B2

(12) United States Patent
Golding

(10) Patent No.: US 6,745,507 B2
(45) Date of Patent: Jun. 8, 2004

(54) ADDRESS ILLUMINATION ASSEMBLY

(76) Inventor: Glenmore A. Golding, 157 Circle Dr. East, Elmont, NY (US) 11003

( * ) Notice: Subject to any disclaimer, the term of this patent is extended or adjusted under 35 U.S.C. 154(b) by 0 days.

(21) Appl. No.: 10/152,911

(22) Filed: May 23, 2002

(65) Prior Publication Data

US 2003/0217493 A1 Nov. 27, 2003

(51) Int. Cl.[7] ..... G09F 13/04; G09F 13/06

(52) U.S. Cl. ..... 40/564; 40/580; 362/812

(58) Field of Search ..... 40/564, 573, 575, 40/576, 580; 362/800, 812; 439/374, 660

(56) References Cited

U.S. PATENT DOCUMENTS

| | | | | | |
|---|---|---|---|---|---|
| 568,204 | A | | 9/1896 | Norden | 40/541 |
| 814,684 | A | | 3/1906 | Fleming et al. | 40/541 |
| 1,192,803 | A | | 7/1916 | Tucker et al. | 40/541 |
| 1,760,767 | A | | 5/1930 | Müller | 40/541 |
| 2,479,500 | A | | 8/1949 | Longberg | |
| 2,694,270 | A | * | 11/1954 | Spitzer | 40/546 |
| 3,310,670 | A | | 3/1967 | Sheppard | |
| 4,532,579 | A | * | 7/1985 | Merryman | 362/239 |
| 4,768,300 | A | | 9/1988 | Rutili | 40/546 |
| 4,848,017 | A | * | 7/1989 | Bailey et al. | 40/576 |
| 4,854,062 | A | | 8/1989 | Bayo | 40/551 |
| 4,901,461 | A | | 2/1990 | Edwards et al. | 40/575 |
| 4,951,406 | A | * | 8/1990 | Lemire | 40/576 |
| 5,020,253 | A | | 6/1991 | Lie et al. | 40/576 |
| 5,526,236 | A | | 6/1996 | Burnes et al. | |
| 5,633,565 | A | | 5/1997 | Friedman et al. | |
| 5,771,617 | A | * | 6/1998 | Baker | 40/544 |
| 5,778,579 | A | | 7/1998 | Yuen | 40/564 |
| 5,911,524 | A | | 6/1999 | Wilton | 40/574 |
| 6,060,838 | A | | 5/2000 | Cantoni et al. | |
| 6,098,326 | A | | 8/2000 | Campbell, III | 40/575 |
| 6,177,877 | B1 | | 1/2001 | Munyon | 340/815.4 |
| 6,276,079 | B1 | | 8/2001 | Tijanic | 40/591 |
| 6,299,325 | B1 | | 10/2001 | Cathel | 362/183 |
| 6,326,735 | B1 | | 12/2001 | Wang et al. | 315/169.3 |
| 6,341,440 | B1 | | 1/2002 | Lee | 40/546 |
| 6,401,373 | B1 | * | 6/2002 | Sexton | 40/576 |
| 6,568,109 | B2 | * | 5/2003 | Sanders | 40/447 |
| 2002/0003697 | A1 | | 1/2002 | Chien | |

FOREIGN PATENT DOCUMENTS

| | | | | |
|---|---|---|---|---|
| JP | 3-235987 | | 10/1991 | |
| WO | WO-90/07173 | * | 6/1990 | 40/564 |

* cited by examiner

*Primary Examiner*—Brian K. Green
(74) *Attorney, Agent, or Firm*—Richard C. Litman

(57) ABSTRACT

An address illumination assembly includes first and second end elements, a sensor element, and at least one alphanumeric element. The first and second end elements are configured to secure together the sensor element and the alphanumeric elements. The sensor element includes a sensor cover, a sensor base, and a sensor printed circuit board positioned therebetween. The sensor base includes electrical contacts to pass electric current from the sensor element to another element. The sensor printed circuit board includes an electrical circuit that includes a photo sensor, a bipolar switch, a potentiometer switch, and associated electrical elements and wiring. The alphanumeric element includes an alphanumeric cover, an alphanumeric base, and an alphanumeric light board positioned therebetween. The alphanumeric base of the alphanumeric element includes electrical contacts to pass electric current from the alphanumeric element to another element.

16 Claims, 11 Drawing Sheets

ADDRESS ILLUMINATION ASSEMBLY

BACKGROUND OF THE INVENTION

1. Field of the Invention

The present invention relates generally to illuminated address systems and, more particularly, to an address illumination assembly that illuminates address indicia based on ambient light conditions.

2. Description of the Related Art

Society is not immune to natural or other disasters that necessitate quick response from emergency service departments, such as fire departments, police, or the like. In the prior art, various and different types of illuminated displays have been proposed for building or house addresses.

The related art is represented by the following patents of interest.

U.S. Patent Application Publication No. 2002/0003697 A1, published on Jan. 10, 2002 for Tseng-Lu Chien, describes an outdoor lighting with organic elements. Chien does not disclose an address illumination assembly according to the claimed invention.

U.S. Pat. No. 568,204, issued on Sep. 22, 1896 to Mortimer Norden, describes an electric sign. Norden does not disclose an address illumination assembly according to the claimed invention.

U.S. Pat. No. 814,684, issued on Mar. 13, 1906 to Samuel W. Fleming et al., describes an illuminated sign. Fleming et al. does not disclose an address illumination assembly according to the claimed invention.

U.S. Pat. No. 1,760,767, issued on May 27, 1930 to Georg G. Müller, describes an illuminating structure. Müller does not disclose an address illumination assembly according to the claimed invention.

U.S. Pat. No. 1,192,803, issued on Jul. 25, 1916 to James E. Tucker et al., describes an electrically-illuminated display device. Tucker et al. does not disclose an address illumination assembly according to the claimed invention.

U.S. Pat. No. 2,479,500, issued on Aug. 16, 1949 to Harry E. Longberg, describes an illuminating means. Longberg does not disclose an address illumination assembly according to the claimed invention.

U.S. Pat. No. 3,310,670, issued on Mar. 21, 1967 to Ronald W. Sheppard, describes a sealed illuminator. Sheppard does not disclose an address illumination assembly according to the claimed invention.

U.S. Pat. No. 4,768,300, issued on Sep. 6, 1988 to Renzo N. Rutili, describes an illuminated information display. Rutili does not disclose an address illumination assembly according to the claimed invention.

U.S. Pat. No. 4,854,062, issued on Aug. 8, 1989 to Luis E. Bayo, describes an illuminated house number device. Bayo does not disclose an address illumination assembly according to the claimed invention.

U.S. Pat. No. 4,901,461, issued on Feb. 20, 1990 to Raymond A. Edwards et al., describes a house identification fixture. Edwards et al. does not disclose an address illumination assembly according to the claimed invention.

U.S. Pat. No. 5,020,253, issued on Jun. 4, 1991 to Liat-Chaw Lie et al., describes a display board assembly. Lie et al. does not disclose an address illumination assembly according to the claimed invention.

U.S. Pat. No. 5,526,236, issued on Jun. 11, 1996 to James J. Burnes et al., describes a lighting device used in an exit sign. Burnes et al. does not disclose an address illumination according to the claimed invention.

U.S. Pat. No. 5,563,565, issued on May 27, 1997 to Roni Friedman et al., describes an electronic flasher circuit. Friedman et al. does not disclose an address illumination assembly according to the claimed invention.

U.S. Pat. No. 5,778,579, issued on Jul. 14, 1998 to Shu Wing Yuen, describes an illuminated house number. Yuen does not disclose an address illumination assembly according to the claimed invention.

U.S. Pat. No. 5,911,524, issued on Jun. 15, 1999 to Timothy B. Wilton, describes an automated, illuminated address display and entrance light. Wilton does not disclose an address illumination assembly according to the claimed invention.

U.S. Pat. No. 6,060,838, issued on May 9, 2000 to James L. Cantoni et al., describes an illumination device. Cantoni et al. does not disclose an address illumination assembly according to the claimed invention.

U.S. Pat. No. 6,098,326, issued on Aug. 8, 2000 to Warren A. Campbell, III, describes a locator sign. Campbell, III does not disclose an address illumination assembly according to the claimed invention.

U.S. Pat. No. 6,177,877 B1, issued on Jan. 23, 2001 to Timothy Munyon, describes a hand-held programmable sign with a rotatable handle. Munyon does not disclose an address illumination assembly according to the claimed invention.

U.S. Pat. No. 6,276,079 B1, issued on Aug. 21, 2001 to Veso S. Tijanic, describes a reflective display with front lighting. Tijanic does not disclose an address illumination assembly according to the claimed invention.

U.S. Pat. No. 6,299,325 B1, issued on Oct. 9, 2001 to Wayne Cathel, describes an illuminating address indication device. Cathel does not disclose an address illumination assembly according to the claimed invention.

U.S. Pat. No. 6,326,735, issued on Dec. 4, 2001 to Shaw-Jong Wang et al., describes a long-life type colorful electroluminescent display panel. Wang et al. does not disclose an address illumination assembly according to the claimed invention.

U.S. Pat. No. 6,341,440 B1, issued on Jan. 29, 2002 to Ching-Chuan Lee, describes a multi-function signboard. Lee does not disclose an address illumination assembly according to the claimed invention.

Japan Patent document 3-235987, published on Oct. 21, 1991, describes a graphic panel. Japan '987 does not disclose an address illumination assembly according to the claimed invention.

None of the above inventions and patents, taken either singularly or in combination, is seen to describe the instant invention as claimed.

SUMMARY OF THE INVENTION

The present invention is an address illumination assembly. The illumination assembly includes first and second end elements, a sensor element, and at least one alphanumeric element. The first and second end elements are configured to secure together the sensor element and the alphanumeric elements. The first end element includes a base with two sides longitudinally extending from ends of the first end element base that define therebetween a recess configured to cooperate with the sensor element. The second end element includes a base with one side longitudinally extending from a central portion of the base that is configured to cooperate with an alphanumeric element.

The sensor element includes a sensor cover, a sensor base, and a sensor printed circuit board positioned therebetween. The sensor cover and sensor base each include peripheral side walls extending therefrom that cooperate with each other to form the sensor element and provide a cavity wherein the sensor printed circuit board is housed. The sensor base includes electrical contacts to pass electric current from the sensor element to another element. The sensor printed circuit board includes an electrical circuit that includes a photo sensor, a bipolar switch, a potentiometer switch, and associated electrical elements and wiring. The electrical circuit may also include a switch configured to replace a door bell of a designated user location. The sensor printed circuit board may also include a power cord for receiving external AC power voltage. The electrical circuit rectifies and regulates the external power voltage down to a DC voltage for driving light sources of the alphanumeric elements.

The alphanumeric element includes an alphanumeric cover, an alphanumeric base, and an alphanumeric light board positioned therebetween. The alphanumeric cover and alphanumeric base each include peripheral side walls extending therefrom that cooperate with each other to form the alphanumeric element and provide a cavity wherein the alphanumeric light board is housed. The alphanumeric cover has front side and a back side. The front and back side each have portions that may include a transparent portion, a translucent portion, an opaque portion, or combinations thereof. The transparent or translucent portion may be configured in the form of an alphanumeric character such as a number, a letter, or the like. The transparent or translucent portion may be clear, tinted, shaded, or colored according to the desires of the user. The alphanumeric base of the alphanumeric element includes electrical contacts to pass electric current from the alphanumeric element to another element.

The alphanumeric light board may be configured as a universal light board (e.g., capable of illuminating any desired alphanumeric character), and include an X-Y array of light sources to emit light in a direction away from the light board. The light sources are mounted in the light board in a conventional manner, e.g., by soldering the leads (i.e., anode and cathode) to the light board such that the light sources are properly oriented. Alternatively, the alphanumeric light board may be configured to illuminate one predetermined alphanumeric character through the use of a light transmission tube.

The address illumination assembly may also include alphanumeric element that includes an alphanumeric cover and an alphanumeric base, and does not include a universal alphanumeric light board positioned therebetween. The configuration of such an alphanumeric element is substantially the same as the alphanumeric element described above. However, the alphanumeric cover of such an alphanumeric element is opaque and does not include a transparent or translucent portion. This alphanumeric element may also be colored according to the desires of the user. For example, this alphanumeric element may be colored in accordance with any corresponding end, sensor, and/or alphanumeric elements.

The end elements, sensor cover, sensor base, alphanumeric covers, and alphanumeric bases may be made from any desirable material, such as plastic, metal, wood, etc., and may be dimensioned according to the desires of the manufacturer.

The illuminated address assembly is configured to counter and subsequently eliminate the problem of finding an address at night. The plate allows the fire department, the police, and any other emergency service to find the address at critical times when every second counts.

Accordingly, it is a principal aspect of the invention to provide an illuminated address assembly that improves visibility and aesthetic appeal.

It is another aspect of the invention to provide and illuminated address assembly that is adaptable for residential, commercial, and industrial use.

It is an aspect of the invention to provide improved elements and arrangements thereof in an illuminated address assembly for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
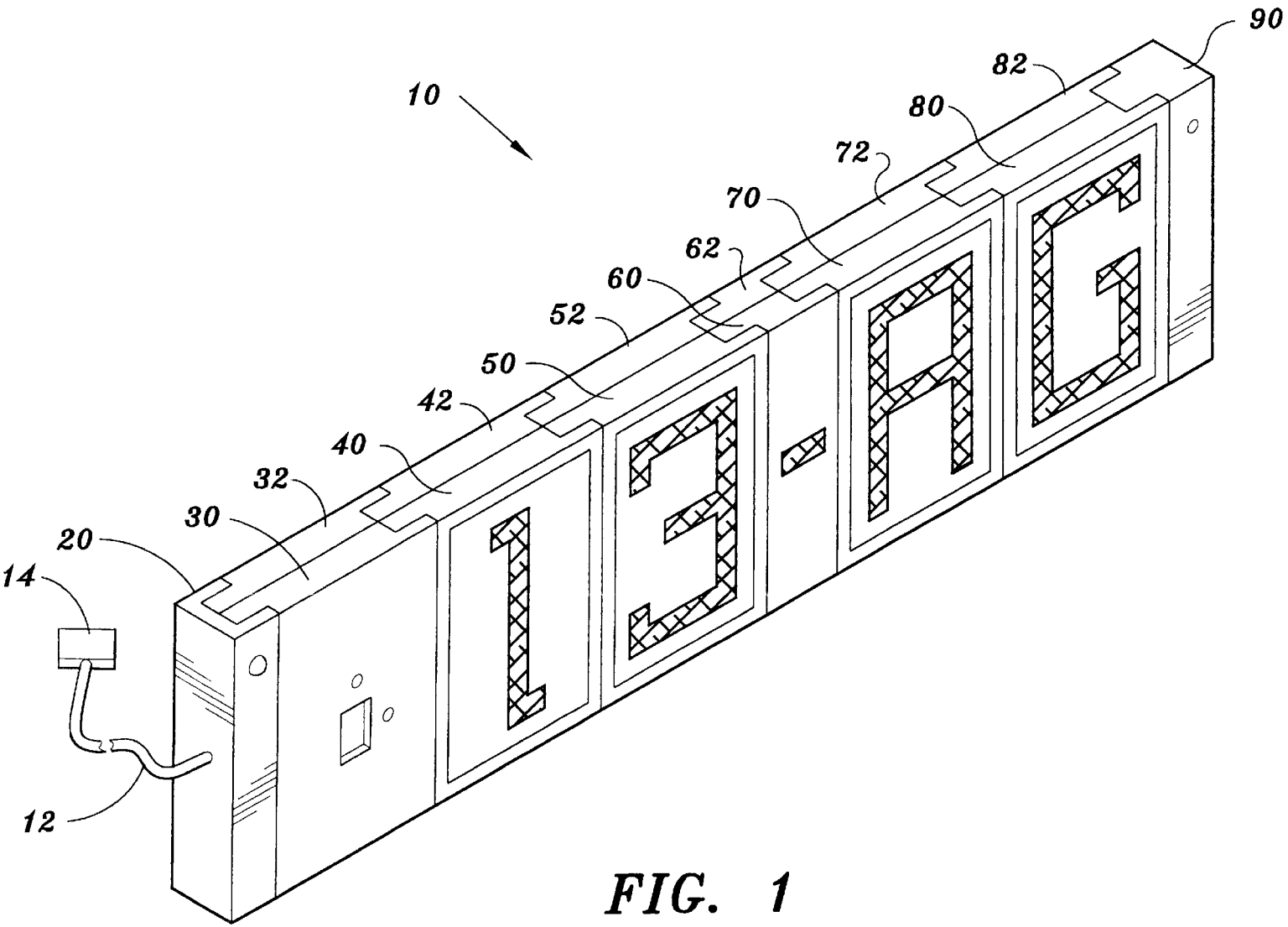
FIG. 1 is a front perspective view of an address illumination assembly according to the present invention.

This present invention is an address illumination assembly. The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

Referring to the drawings, FIGS. 1–7 illustrate one example of an address illumination assembly 10 that includes first and second end elements, a sensor element, and at least one alphanumeric element. The first and second end elements 20, 90 are configured to secure together the sensor element and the alphanumeric elements. As shown in FIG. 2A, the first end element 20 is generally configured in the form of a "U", e.g., the first end element includes a base with two sides longitudinally extending from ends of the first end element base that define therebetween a recess configured to cooperate with the sensor element. The base has an aperture 28 defined therein having a size configured to receive a power cord from the sensor element. The two sides of the first end element each have an aperture 22, 24 defined therein having a size configured to receive a fastener, such as a screw, therethrough to provide the ability to fasten the illumination assembly to an appropriate mount.

Figure 3:
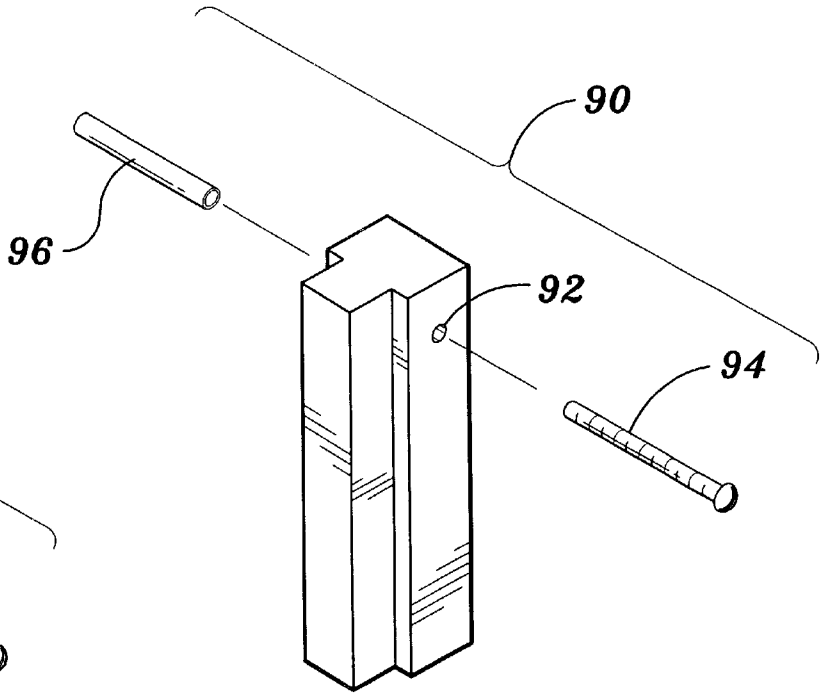
FIG. 3 is a front perspective exploded view of a right bracing element of an address illumination assembly according to the present invention.
Figure 2:
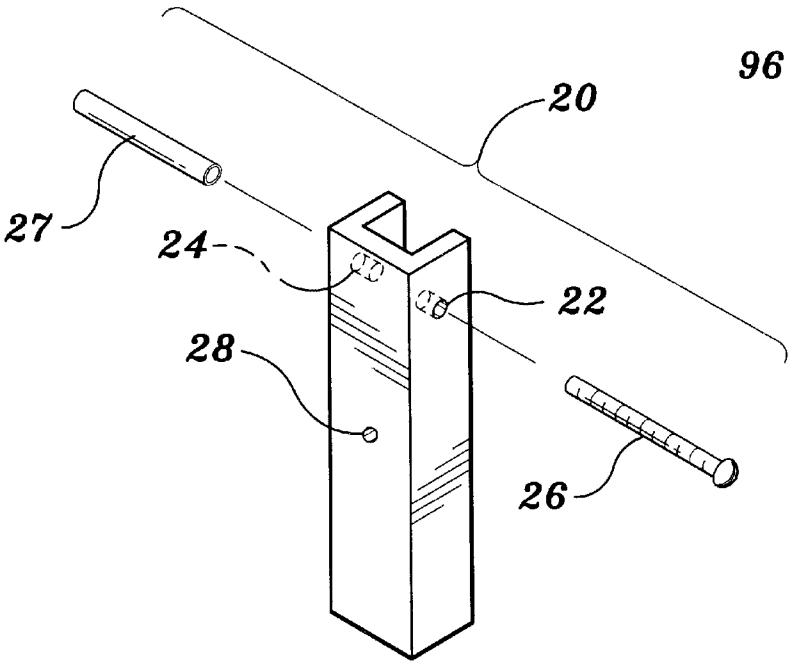
FIG. 2 is a front perspective exploded view of a left bracing element of an address illumination assembly according to the present invention.

As shown in FIG. 3, the second end element 90 is generally configured in the form of a "T", e.g., the second end element 90 includes a base with one side longitudinally extending from a central portion of the base that is configured to cooperate with an alphanumeric element. The base has an aperture 92 defined therein having a size configured to receive a fastener, such as screw, therethrough to provide the ability to fasten the illumination assembly to an appropriate mount. The assembly may also include a member to receive the fastener.

Figure 4B:
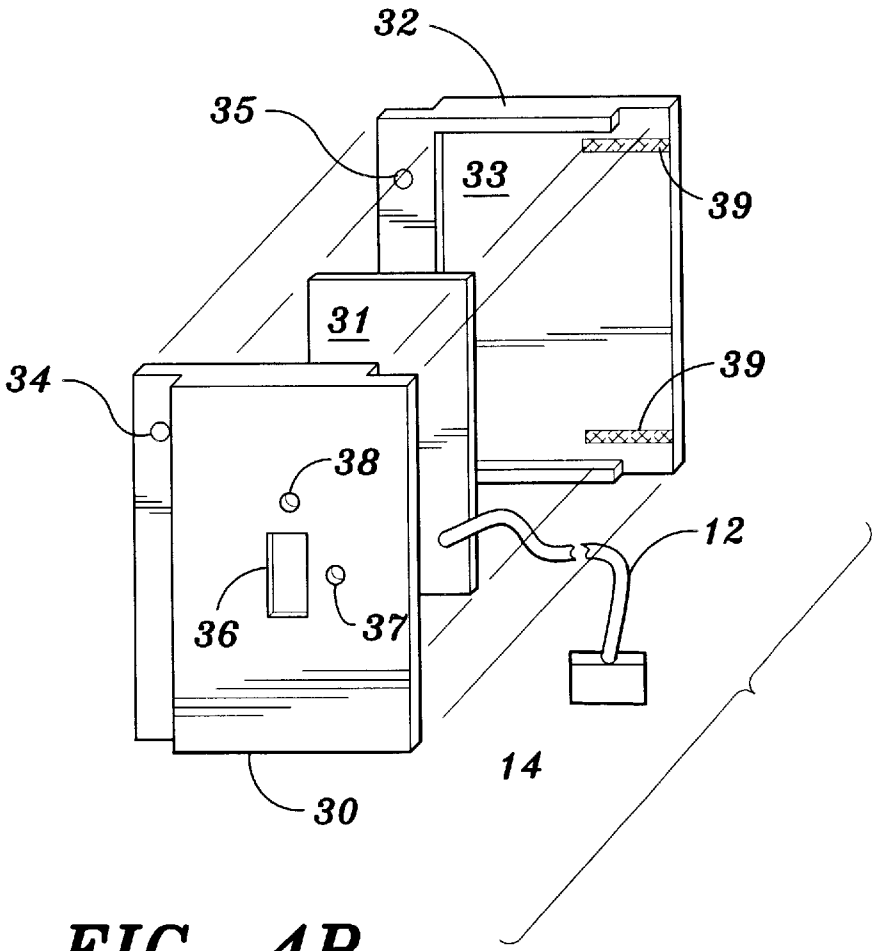
FIG. 4B is a front perspective exploded view of a sensor element of an address illumination assembly according to the present invention.
Figure 4A:
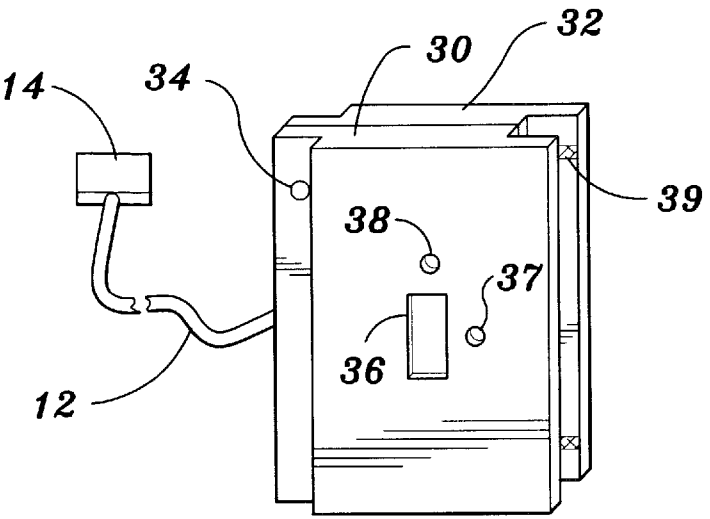
FIG. 4A is a front perspective view of a sensor element of an address illumination assembly according to the present invention.
Figure 5:
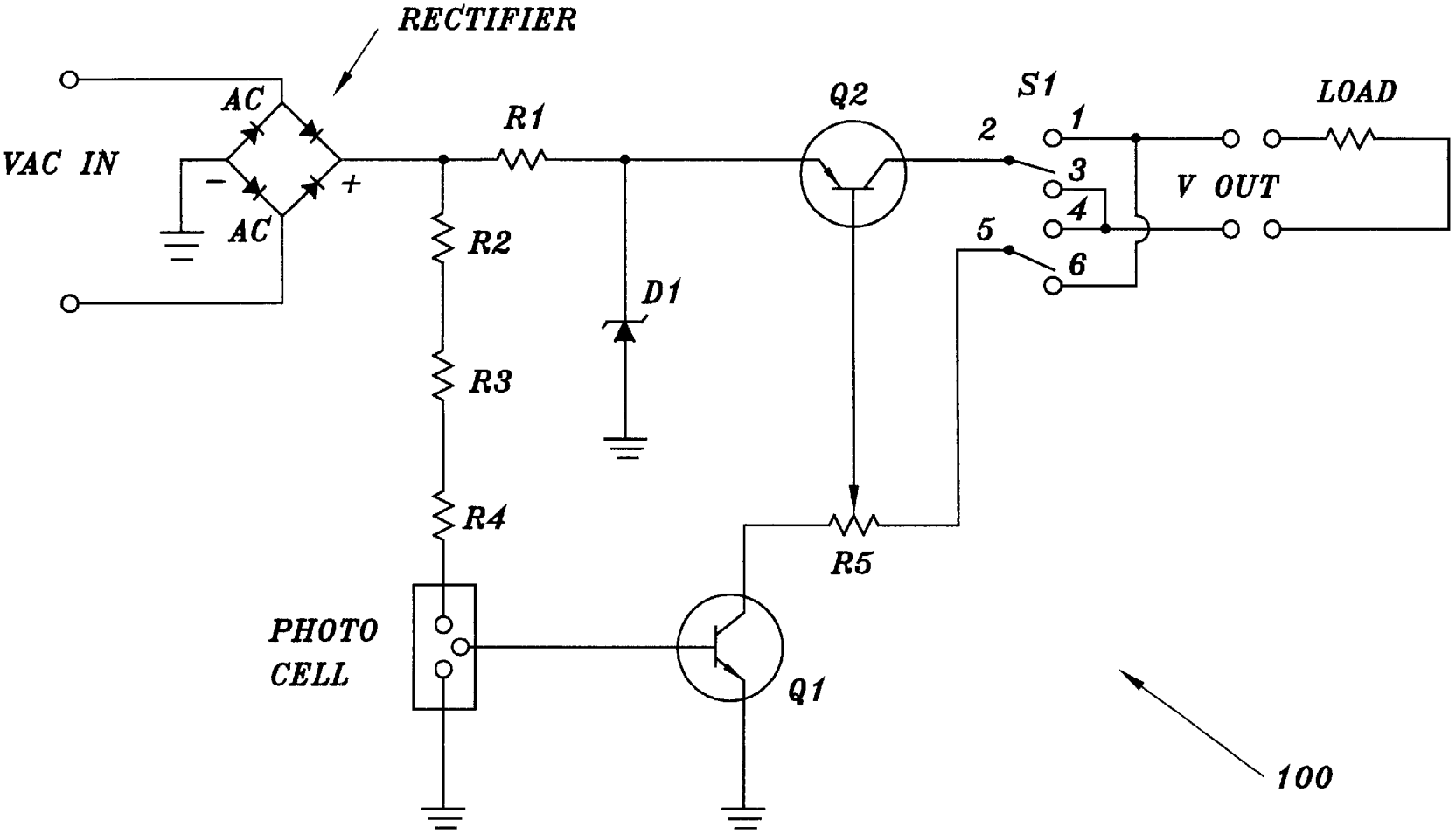
FIG. 5 is a circuit diagram of circuitry on a sensor board element of an address illumination assembly according to the present invention.

Aa shown in FIGS. 4A and 4B, the sensor element includes a sensor cover 30, a sensor base 32, and a sensor printed circuit board 31 positioned therebetween. The sensor cover 30 and sensor base 32 each include peripheral side walls extending therefrom that cooperate with each other to form the sensor element and provide a cavity wherein the sensor printed circuit board 31 is housed. The sensor cover 30 has an aperture 34 defined therein near an edge that has a size configured to receive a fastener, such as screw, therethrough to provide the ability to fasten the illumination assembly to an appropriate mount. The sensor cover also has three apertures 36, 37, 38 defined therein that have sizes configured to receive a photo sensor element, a bipolar switch element, and a potentiometer switch element.

The sensor base 32 includes electrical contacts 39 to pass electric current from the sensor element to another element. The sensor base 32 has plural apertures 35 defined therein having a size configured to receive a fastener, such as screw, therethrough to provide the ability to fasten the illumination assembly to an appropriate mount or to fasten the sensor base 32 to the sensor cover. The sensor printed circuit board 31 includes an electrical circuit 100 that includes a photo sensor, a bipolar switch, a potentiometer switch, and associated electrical elements and wiring (see FIG. 5).

The photo sensor, such as a photo cell or the like, monitors the ambient light level and switches the light sources on when the ambient light level falls below a predetermined threshold and switches the light sources off when the ambient light level rises above the predetermined threshold. The potentiometer switch may be adjusted to set the predetermined threshold at a desired amount. The printed circuit board 31 also includes a power cord 12 for receiving external AC power voltage, such as power to a doorbell switch or from an AC adaptor via a connector 14. The electrical circuit 100 rectifies and regulates the external power voltage down to a DC voltage for driving light sources of the alphanumeric elements. For example, the illumination assembly may be connected in the circuit across the terminals of a doorbell, buzzer, or chime of a residence. The construction and operation of such electrical elements and such an electrical circuit are well known in the art. This invention is not limited to any particular electrical circuit.

Figure 6B:
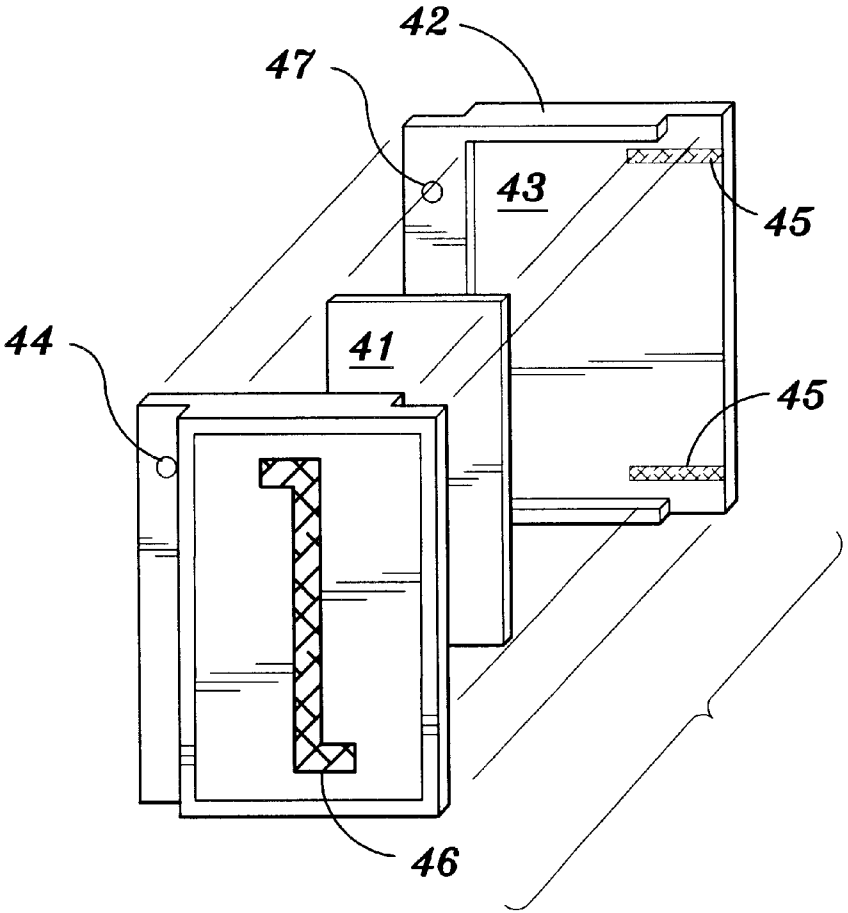
FIG. 6B is a front perspective exploded view of an alphanumeric element of an address illumination assembly according to the present invention.
Figure 6A:
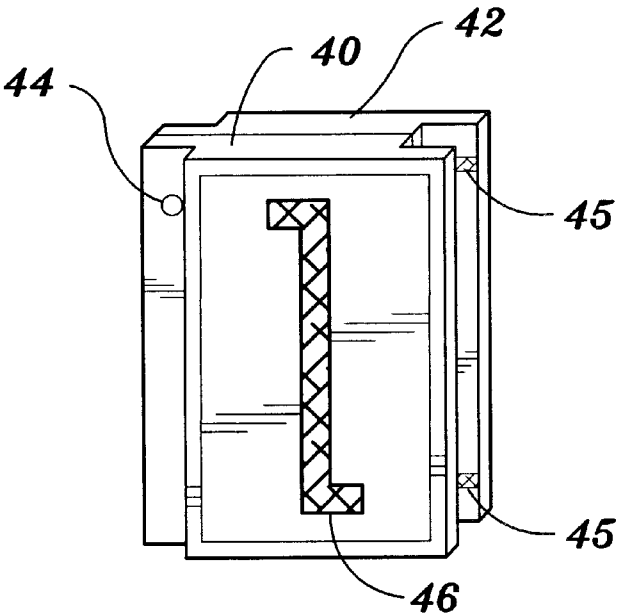
FIG. 6A is a front perspective view of an alphanumeric element of an address illumination assembly according to the present invention.

As shown in FIGS. 6A and 6B, the alphanumeric element includes an alphanumeric cover 40, an alphanumeric base 42, and a universal alphanumeric light board 41 positioned therebetween. The alphanumeric cover 40 and alphanumeric base 42 each include peripheral side walls extending therefrom that cooperate with each other to form the alphanumeric element and provide a cavity wherein the alphanumeric universal light board 41 is housed. The alphanumeric cover 40 has a front side and a back side. The front and back side each have portions that may include a transparent portion, a translucent portion, an opaque portion, or combinations thereof.

A transparent or translucent portion may be configured in the form of an alphanumeric character 46 such as a number, a letter, or the like. The transparent or translucent portion may be clear, tinted, shaded, or colored according to the desires of the user. For example, the transparent or translucent portion may be colored in any of a variety of colors, such as red, orange, white, green, blue, or the like. The opaque portion may also be colored in any of a variety of colors, such as grainy, light yellow, off-white, black marble, orange, granite, or the like. The front side is generally smooth, but may include a recess for the alphanumeric character 46. The back side 42 includes electrical contacts 45 to pass electric current from the alphanumeric element to another element. The back side includes plural extending or recessed bosses configured to receive a fastener, such as screw, therethrough to provide the ability to fasten the alphanumeric cover 40 to the alphanumeric base 42, and to fasten an alphanumeric element to another alphanumeric element, a sensor element, or an end element.

Figure 7:
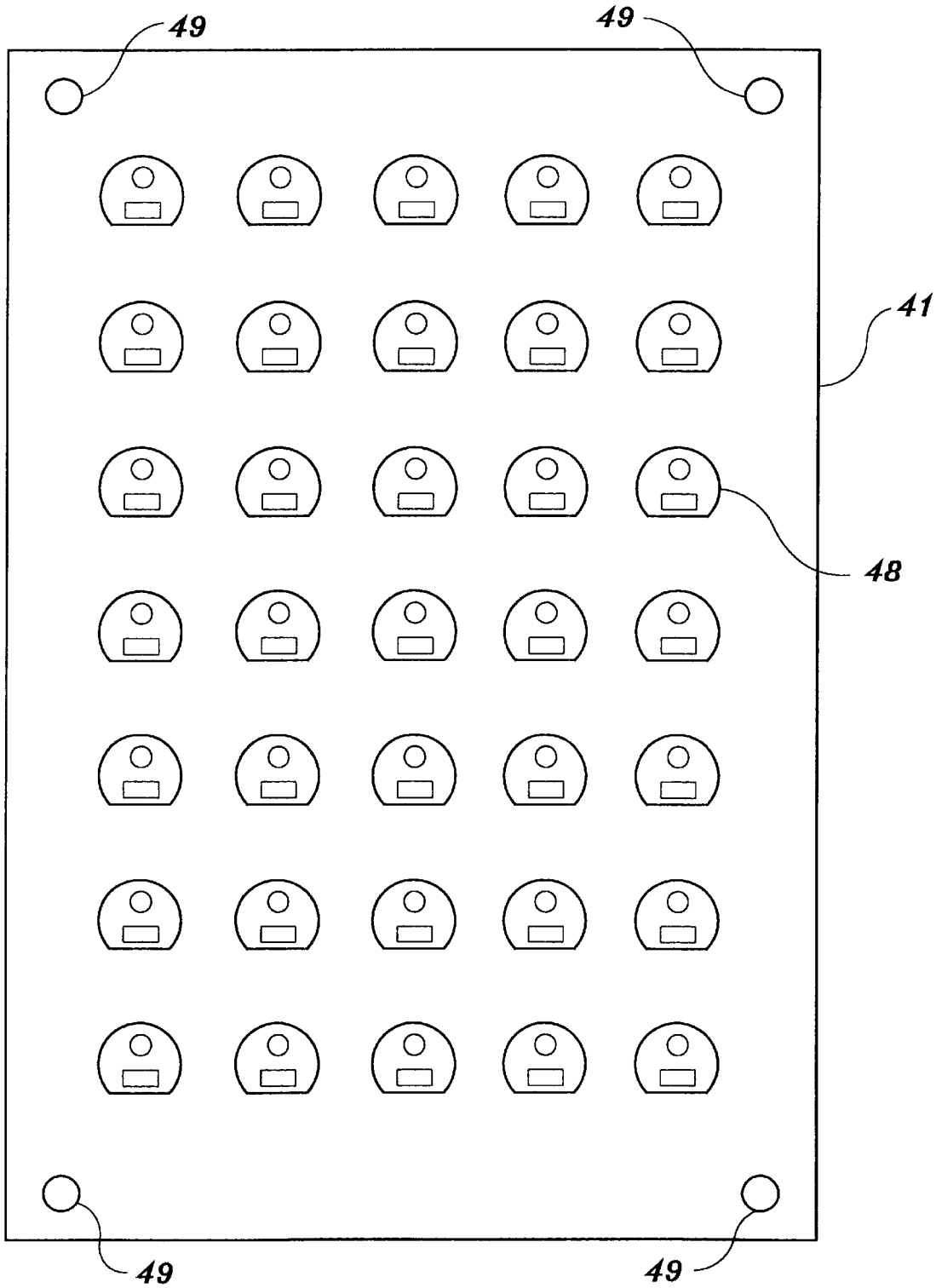
FIG. 7 is a front view of a lighting board of an address illumination assembly according to the present invention.

As shown in FIG. 7, the universal alphanumeric light board 41 includes an X-Y array of light sources 48, such as an array of seven rows by five columns, to emit light in a direction away from the light board. The light sources 48 may be light emitting diodes (LEDs) or any other suitable light source. The light sources 48 are mounted in the light board 41 in a conventional manner, e.g., by soldering the leads (i.e., anode and cathode) to the light board 41 such that the light sources 48 are properly oriented.

The address illumination assembly 10 may also include alphanumeric element that includes an alphanumeric cover 60 and an alphanumeric base 62, and does not include a universal alphanumeric light board positioned therebetween (see FIG. 1). The configuration of such an alphanumeric element is substantially the same as the alphanumeric element described above. However, the alphanumeric cover 60 of such an alphanumeric element is opaque and does not include a transparent or translucent portion. For example, such an alphanumeric element may be configured for particular symbols, such as a dash, and be smaller in size than other alphanumeric elements. This alphanumeric element may also be colored according to the desires of the user. For example, this alphanumeric element may be colored in accordance with any corresponding end, sensor, and/or alphanumeric elements.

FIGS. 8–12 illustrate another example of an address illumination assembly 200 that includes first and second end elements, a sensor element, and at least one alphanumeric element. Address illumination assembly 200 is configured for replacing a conventional door bell or door buzzer (not shown). The first and second end elements are configured to secure together the sensor element and the alphanumeric elements. As with address illumination assembly 10, the first end element 220 is generally configured in the form of a "U", e.g., the first end element includes a base with two sides longitudinally extending from ends of the first end element base that define therebetween a recess configured to cooperate with the sensor element. The two sides of the first end element each have an aperture defined therein having a size configured to receive a fastener, such as a screw, therethrough to provide the ability to fasten the illumination assembly to an appropriate mount.

The second end element is generally configured in the form of a "T", e.g., the second end element includes a base with one side longitudinally extending from a central portion of the base that is configured to cooperate with an alphanumeric element. The base has an aperture defined therein having a size configured to receive a fastener, such as screw, therethrough to provide the ability to fasten the illumination assembly to an appropriate mount. The assembly may also include a member to receive the fastener.

Figure 9B:
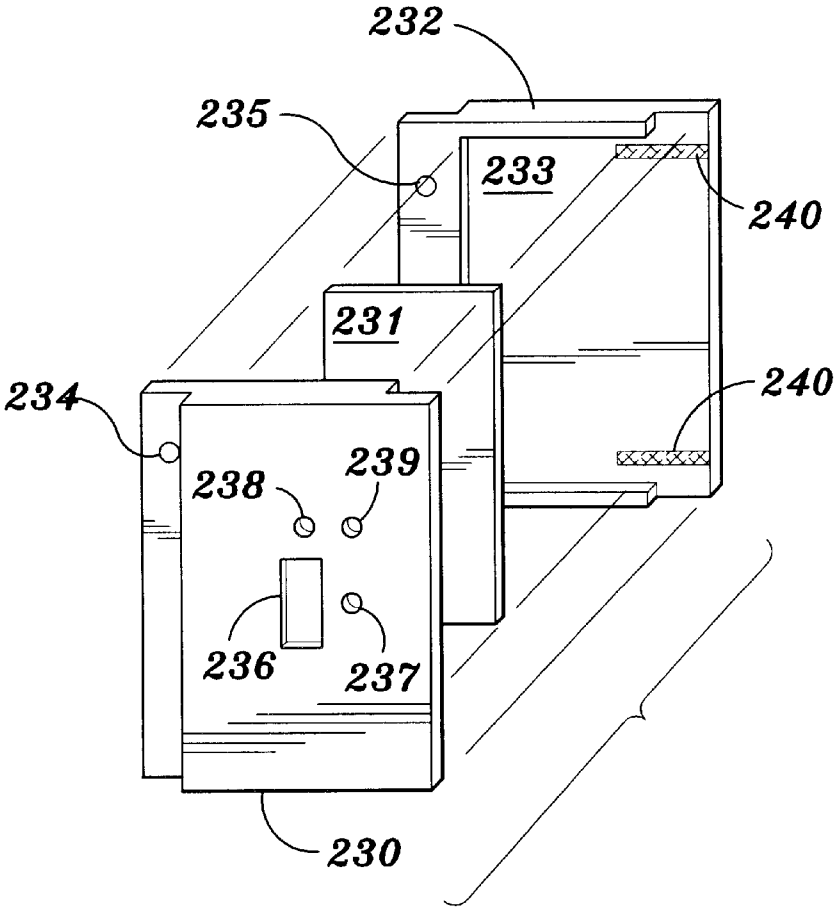
FIG. 9B is a front perspective exploded view of a sensor element of an address illumination assembly according to the present invention.
Figure 9A:
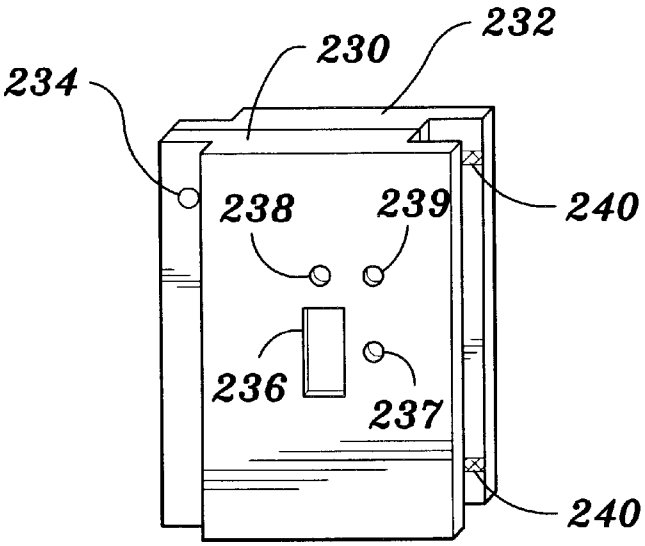
FIG. 9A is a front perspective view of a sensor element of an address illumination assembly according to the present invention.
Figure 10:
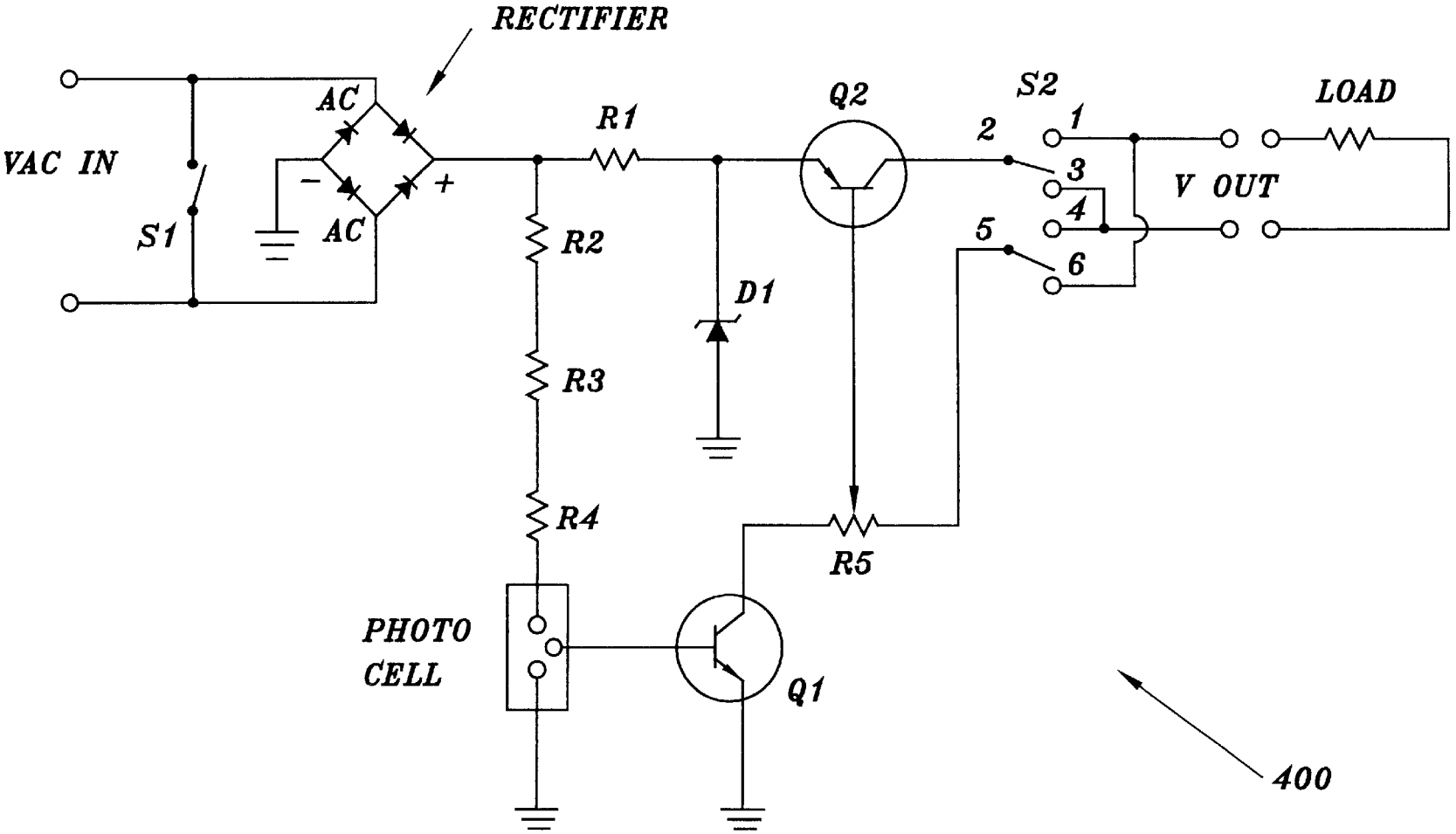
FIG. 10 is a circuit diagram of circuitry on a sensor board element of an address illumination assembly according to the present invention.
Figure 11B:
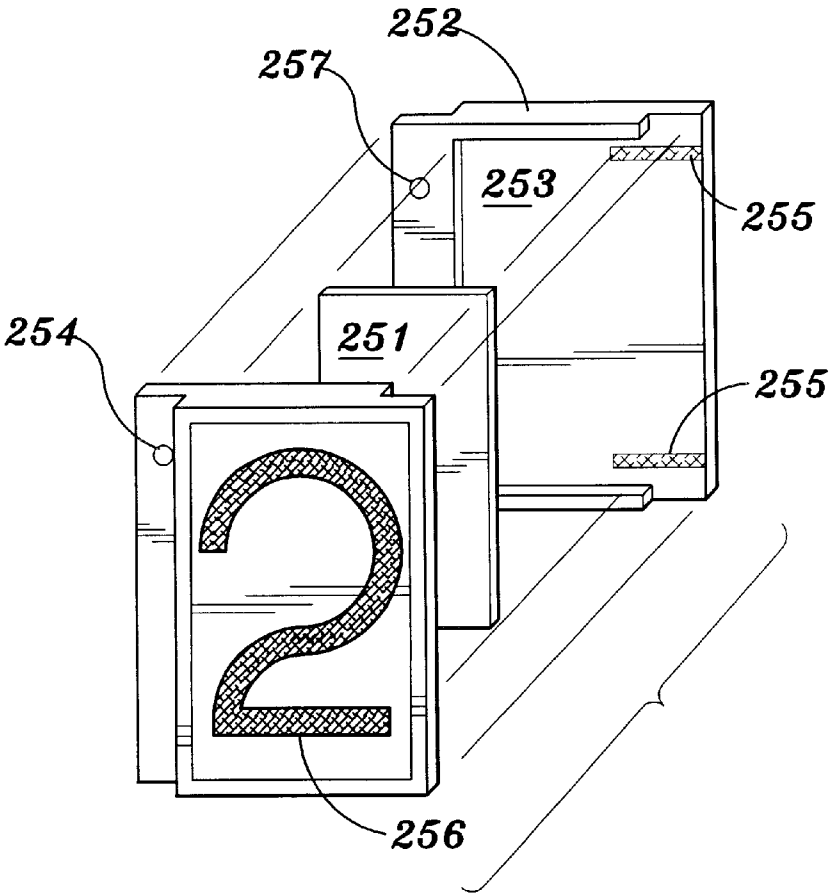
FIG. 11B is a front perspective exploded view of an alphanumeric element of an address illumination assembly according to the present invention.
Figure 11A:
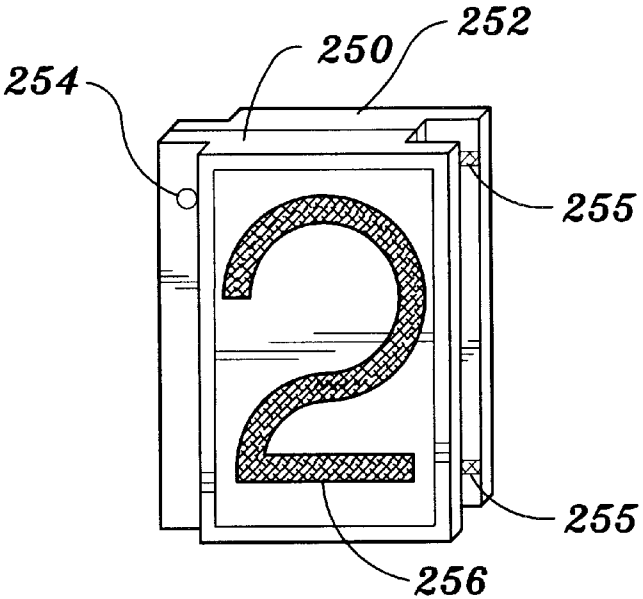
FIG. 11A is a front perspective view of an alphanumeric element of an address illumination assembly according to the present invention.

As shown in FIGS. 9A and 9B, the sensor element includes a sensor cover 230, a sensor base 232, and a sensor printed circuit board 231 positioned therebetween. The sensor cover 230 and sensor base 232 each include peripheral side walls extending therefrom that cooperate with each other to form the sensor element and provide a cavity wherein the sensor printed circuit board 231 is housed. The sensor cover 230 has an aperture 234 defined therein near an edge that has a size configured to receive a fastener, such as screw, therethrough to provide the ability to fasten the illumination assembly to an appropriate mount. The sensor cover 230 also has three apertures 236, 237, 238 defined therein that have sizes configured to receive a photo sensor element, a bipolar switch element, and a potentiometer switch element. In addition, the sensor cover 230 has an aperture defined therein configured to receive a push button or switch 239 to activate a doorbell, chimes, or the like.

The sensor base 232 includes electrical contacts 240 to pass electric current from the sensor element to another element. The sensor base 232 has at least one aperture 235 defined therein having a size configured to receive a fastener, such as screw, therethrough to provide the ability to fasten the illumination assembly to an appropriate mount or to fasten the sensor base 232 to the sensor cover 230. The sensor printed circuit board 231 includes an electrical circuit 400 that includes a switch S1, a photo sensor, a bipolar switch, a potentiometer switch, and associated electrical elements and wiring (see FIG. 10).

Switch S1 corresponds to push button or switch 239. The photo sensor, such as a photo cell or the like, monitors the ambient light level and switches the light sources on when the ambient light level falls below a predetermined threshold and switches the light sources off when the ambient light level rises above the predetermined threshold. The potentiometer switch may be adjusted to set the predetermined threshold at a desired amount. The printed circuit board 231 receives external AC power voltage from a doorbell switch or the like. The electrical circuit 400 rectifies and regulates the external power voltage down to a DC voltage for driving light sources of the alphanumeric elements. For example, the illumination assembly may be connected in the circuit across the terminals of a doorbell, buzzer, or chime of a residence. The construction and operation of such electrical elements and such an electrical circuit are well known in the art. This invention is not limited to any particular electrical circuit.

The alphanumeric element includes an alphanumeric cover 250, an alphanumeric base 252, and an alphanumeric light board 251 positioned therebetween. The alphanumeric cover 250 and alphanumeric base 252 each include peripheral side walls extending therefrom that cooperate with each other to form the alphanumeric element and provide a cavity wherein the alphanumeric universal light board 251 is housed. The alphanumeric cover 250 has a front side and a back side. The front and back side each have portions that may include a transparent portion, a translucent portion, an opaque portion, or combinations thereof.

A transparent or translucent portion may be configured in the form of an alphanumeric character 256 such as a number, a letter, or the like. The transparent or translucent portion may be clear, tinted, shaded, or colored according to the desires of the user. For example, the transparent or translucent portion may be colored in any of a variety of colors, such as red, orange, white, green, blue, or the like. An opaque portion may also be colored in any of a variety of colors, such as grainy, light yellow, off-white, black marble, orange, granite, or the like. The front side is generally smooth, but may include a recess for the alphanumeric character 256. The back side 252 includes electrical contacts 255 to pass electric current from the alphanumeric element to another element. The back side includes plural extending or recessed bosses configured to receive a fastener, such as screw, therethrough to provide the ability to fasten the alphanumeric cover 250 to the alphanumeric base 252, and to fasten an alphanumeric element to another alphanumeric element, a sensor element, or an end element.

Figure 12:
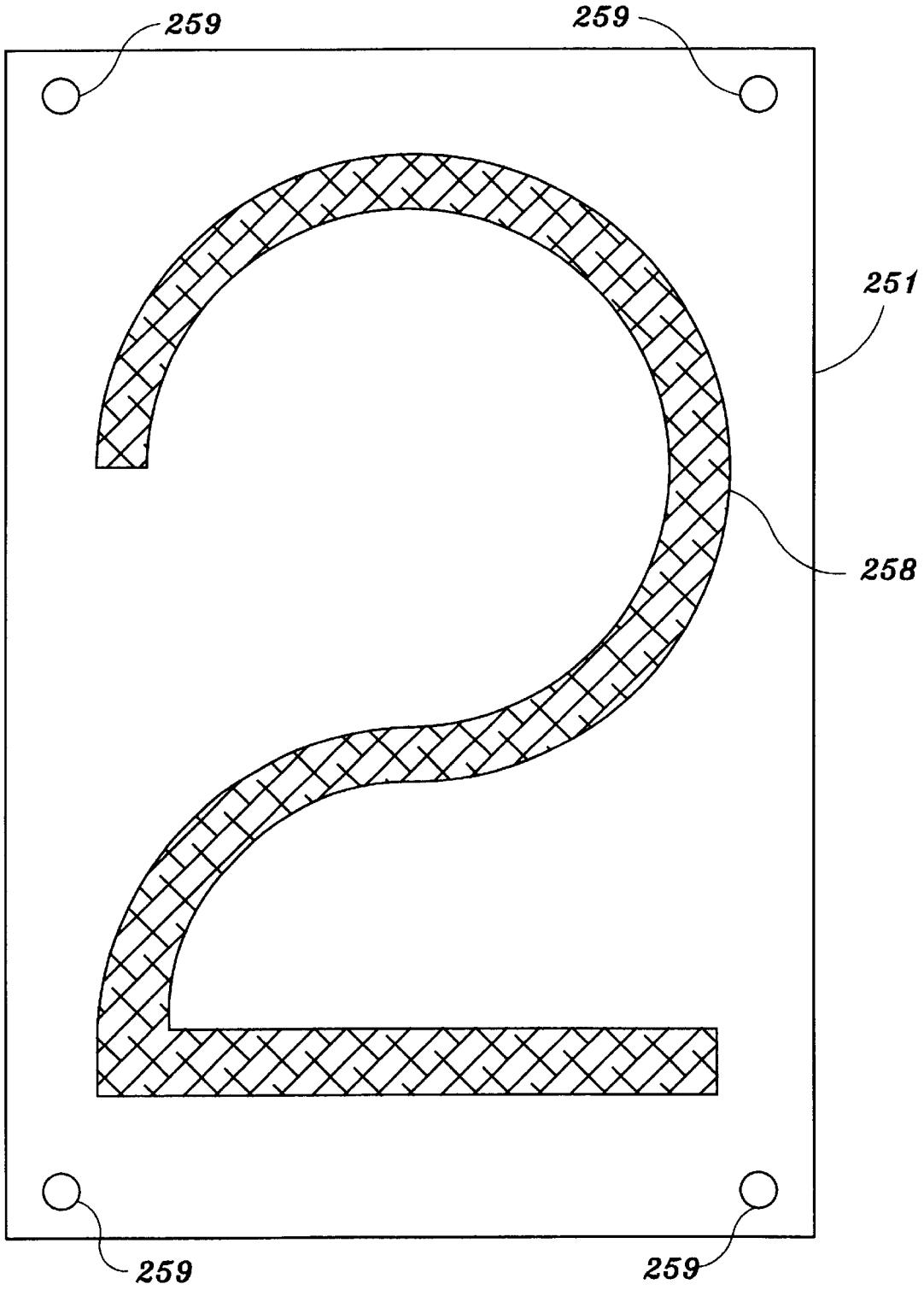
FIG. 12 is a front view of a lighting board of an address illumination assembly according to the present invention.

FIG. 12 illustrates an alphanumeric light board that includes a light transmission tube 258 and a light source disposed at at least one axial end of the light transmission tube. The light transmission tube 258 is configured in the form of a predetermined alphanumeric character. The light transmission tube 258 may be any known light transmission tube. For example, a flexible material moldable into a tube form may be employed, such as plastic, elastomer, or the like. The diameter and length of the light transmission tube 258 may be determined according to the desires of the user. The light source may be an LED or any other suitable light source. The light source and light transmission tube 258 are mounted on the light board 251 in a conventional manner.

Figure 8:
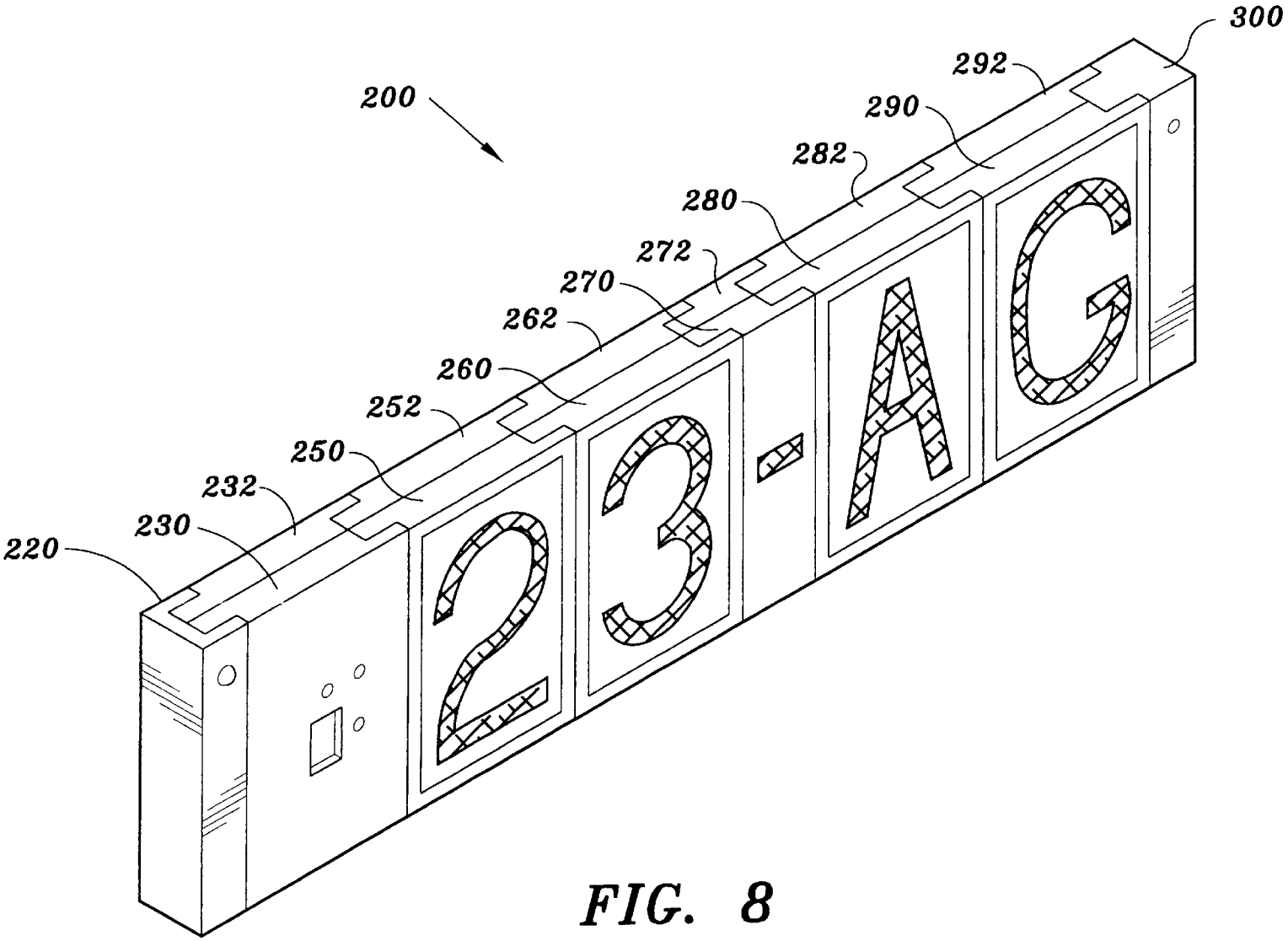
FIG. 8 is a front perspective view of an address illumination assembly according to the present invention.

The address illumination assembly 200 may also include alphanumeric element that includes an alphanumeric cover 270 and an alphanumeric base 272, and does not include a universal alphanumeric light board positioned therebetween (see FIG. 8). The configuration of such an alphanumeric element is substantially the same as the alphanumeric element described above. However, the alphanumeric cover 270 of such an alphanumeric element is opaque and does not include a transparent or translucent portion. For example, such an alphanumeric element may be configured for particular symbols, such as a dash, and be smaller in size than other alphanumeric elements. This alphanumeric element may also be colored according to the desires of the user. For example, this alphanumeric element may be colored in accordance with any corresponding end, sensor, and/or alphanumeric elements.

The end elements, sensor cover, sensor base, alphanumeric covers, and alphanumeric bases may be made from any desirable material, such as plastic, metal, wood, etc., and may be dimensioned according to the desires of the manufacturer.

The illuminated address assembly is configured to counter and subsequently eliminate the problem of finding an address at night. The plate allows the fire department, the police, and any other emergency service to find the address at critical times when every second counts.

While the invention has been described with reference to its preferred embodiment, it will be understood by those skilled in the art that various changes may be made and equivalents may be substituted for elements thereof without departing from the true spirit and scope of the invention.

I claim:

1. An address illumination assembly comprising:

a first end element generally configured in a form of a U;

a second end element generally configured in a form of a T;

a sensor element having a left side, a right side, a sensor cover, a sensor base, and a sensor printed circuit board positioned therebetween, the left side of the sensor element being generally configured in a form of a T, and the right side of the sensor element being generally configured in a form of a U; and at least one alphanumeric element having a left side, a right side, an alphanumeric cover, an alphanumeric base, and a universal alphanumeric light board positioned therebetween the alphanumeric cover having an alphanumeric character thereon, the universal alphanumeric light board having an X-Y array of light sources arranged in a plurality of rows and columns for illuminating any alphanumeric character on the alphanumeric cover, the left side of each alphanumeric element being generally configured in a form of a T, and the right side of each alphanumeric element being generally configured in a form of a U;

wherein the right side of said first element is configured to engage with the left side of the sensor, and the left side of the second element is configured to engage with the right side of one of the at least one alphanumeric element to secure together the sensor element and the one of the at least one alphanumeric element.

2. The address illumination assembly according to claim 1, wherein said first end element includes a base with two sides longitudinally extending from ends of said base of said first end element that define therebetween a recess configured to cooperate with said sensor element.

3. The address illumination assembly according to claim 2, wherein said base of said first end element has an aperture defined therein having a size configured to receive a power cord from said sensor element, and said two sides each have an aperture defined therein having a size configured to receive a fastener therethrough to provide an ability to fasten said address illumination assembly to an appropriate mount.

4. The address illumination assembly according to claim 1, wherein said second end element includes a base with one side longitudinally extending from a central portion of said base that is configured to cooperate with one of said at least one alphanumeric element.

5. The address illumination assembly according to claim 4, wherein said base of said second end element has an aperture defined therein having a size configured to receive a fastener therethrough to fasten said address illumination assembly to an appropriate mount.

6. The address illumination assembly according to claim 1, wherein said sensor cover and said sensor base each include peripheral side walls extending therefrom that cooperate with each other to form said sensor element and provide a cavity wherein said sensor printed circuit board is housed.

7. The address illumination assembly according to claim 6, wherein said sensor cover has an aperture defined therein near an edge that has a size configured to receive a fastener therethrough to fasten said address illumination assembly to an appropriate mount, and has three apertures defined therein that have sizes configured to receive a photo sensor element, a bipolar switch element, and a potentiometer switch element.

8. The address illumination assembly according to claim 6, wherein said sensor base has plural apertures defined therein each having a size configured to receive a fastener therethrough to fasten said address illumination assembly to an appropriate mount or to fasten said sensor base to said sensor cover.

9. The address illumination assembly according to claim 1, wherein said sensor printed circuit board includes an electrical circuit that includes a photo sensor, a bipolar switch, and a potentiometer switch.

10. The address illumination assembly according to claim 9, wherein said electrical circuit further comprises a power cord for receiving external AC power voltage.

11. The address illumination assembly according to claim 9, wherein said electrical circuit rectifies and regulates said external power voltage down to a DC voltage to drive light sources of said at least one alphanumeric element.

12. The address illumination assembly according to claim 1, wherein said alphanumeric cover and said alphanumeric base each include peripheral side walls extending therefrom that cooperate with each other to form said at least one alphanumeric element and provide a cavity wherein said alphanumeric universal light board is housed.

13. The address illumination assembly according to claim 12, wherein said back side includes plural bosses configured to receive a fastener therethrough to fasten said alphanumeric cover to said alphanumeric base.

14. The address illumination assembly according to claim 1, wherein said array is an array of seven rows by five columns.

15. The address illumination assembly according to claim 1, wherein said light sources are light emitting diodes.

16. The address illumination assembly according to claim 1, wherein said alphanumeric cover and alphanumeric base are fully opaque.

* * * * *